United States Patent [19]

Johnson

[11] 4,439,774

[45] Mar. 27, 1984

[54] ANTENNA REFLECTOR WITH TRIANGULATED CELLULAR BACK STRUCTURE

[75] Inventor: Robert E. Johnson, Canoga Park, Calif.

[73] Assignee: International Telephone and Telegraph Corporation, New York, N.Y.

[21] Appl. No.: 219,441

[22] Filed: Dec. 23, 1980

[51] Int. Cl.[3] ..... H01Q 15/16

[52] U.S. Cl. ..... 343/912

[58] Field of Search ..... 343/840, 912, 915, 916

[56] References Cited

U.S. PATENT DOCUMENTS 2,423,648 7/1947 Hansell ..... 343/840

3,964,071 6/1976 Townes et al. ..... 343/912

*Primary Examiner*—Eli Lieberman

*Attorney, Agent, or Firm*—William T. O'Neil

[57] ABSTRACT

A triangulated rib structure including first, second and third sets of "egg-crate" interlocking ribs. The first set is oriented in a predetermined direction such as the horizontal or vertical coordinate, and the second and third sets are oriented at angles of first and second senses, respectively, thereby forming triangulated spaces which are inherently rigid. The individual ribs have edges falling adjacent to a desired overall reflector surface, each of these being precut before assembly to provide the required line of curvature as a function of the individual ribs placement. Each rib is itself a planar piece, and the "egg-crate" interlocking slot joints may be stabilized with one or more seam welds. A conductive mesh forming the actual contoured reflector surface is conformed to the desired contoured shape and affixed as by tack-welding to the edges of the ribs adjacent the contoured surface.

7 Claims, 2 Drawing Figures

ANTENNA REFLECTOR WITH TRIANGULATED CELLULAR BACK STRUCTURE

BACKGROUND OF THE INVENTION

1. Field of the Invention

The invention pertains generally to the formation of contoured surfaces requiring structural backup, and more particularly to conductive contoured surfaces such as required for radar reflectors.

2. Description of the Prior Art

Radar reflectors have been fabricated in various ways in the prior art. A typical reflector comprises a contoured concave reflective surface of sheet metal or a conductive mesh having dimensional parameters for the frequency or band-to-frequencies concerned causing it to perform substantially as a continuous conductive sheet.

The typical radar reflector or "dish" is rotatably mounted and is exposed to wind and other environmental forces. The accuracy and stability of the contoured reflector surface must meet close tolerances from the time of manufacture and throughout extended service. Often a rigid sheet with complex back support and cross-bracing has been employed, the manuacture thereof requiring complex and costly tooling.

Other approaches to the construction of radar reflectors in particular, include the "lay-up" of a structural plastic reflector surface over a conductive mesh spread over a convex mandril which provides a mold for the desired concave reflector shape. To obtain the desired rigidity over the long term, various reinforcing members must be built directly into the plastic lay-up , and a metallic backup arrangement usually a metallic structural network assembled to provide a rigid backup and shape-holding function, is required. This extra backup structure usually also provides the pedestal interface by means of which the reflector is rotated in at least one plane.

In addition to cost, the matter of weight is also an important consideration since rotating radar reflectors are often placed on towers, masts or other structures, those being required to be correspondingly heavy if the reflector structure itself is heavy.

In accordance with the foregoing it will be understood that light, strong and inexpensively manufactured radar reflector structures are of great technical and economic importance.

In the search for radar reflector constructions meeting the aforementioned objectives of strength and low-cost, etc., a so-called "egg-crate" structure has evolved in the prior art. In that prior art, a plurality of horizontal and vertical ribs are notched together. The desired reflecting surface contour is cut into these ribs so that their edge is adjacent to the reflecting surface, each provides a shape appropriate for the location of each rib within the structure. The resulting structure is both a template for forming the mesh reflector surface and is also the supporting structure for the reflector in operation.

Obviously, the prior art horizontal and vertical ribs form square or rectangular spaces backing up the actual reflector mesh surface, however additional structural bracing and support is required in order to prevent these square or rectangular spaces from deforming into parallelograms. That deformation could occur during fabrication or in operation absent a substantial amount of additional bracing and over structure. Still further, the periphery of a reflector fabricated in this manner is generally rectangular in projected outline, whereas the primary feed pattern of a microwave horn associated therewith for illuminating the reflector tends to project equal-power contours onto the reflector which are of themselves elliptical. Accordingly, a mismatch develops and is reflected into the illuminating horn and its associated microwave components, adversely affecting the efficiency of operation. Moreover, spill-over losses and increased side lobe levels in the transmitted (or received) overall antenna pattern result.

The manner in which the invention overcomes the aforementioned prior art difficulties will be understood as this description proceeds.

SUMMARY OF THE INVENTION

In accordance with the state of the related prior art, it may be said to have been the general objective of the invention to provide a strong, economically manufactured and inherently mechanically stable structure for a radar reflector or the like.

The so-called "egg-crate" backup structure is employed in the combination of the invention, structural ribs being provided in three different orientations. If the reflector is assumed to have its greatest width dimension horizontally, then the first set of structural ribs is horizontal. The ribs of the second and third sets are diagonally oriented with respect to the ribs of the first set, those of the second set making an angle in a first sense with respect to the first set of ribs and the ribs of the third set making essentially the same angle but of the opposite sense with respect to the ribs of the first set. Accordingly, a cellular structure is produced in which the individual cells are triangular. All ribs are relatively deep in the generally normal direction with respect to the contoured reflector surface produced, and all are slotted at the cross-over points. Still further all ribs are planar and have their edges contoured adjacent to the contoured reflector surface at their individual positions. The result is a strong, dimensionally stable structure, the base portion of which may be more or less directly attached to a pedestal rotator or other mounting.

Modern computer controlled machine tools are capable of cutting the edges of each individual rib in accordance with the required contour of each to make it congruent with the overall contoured reflector surface at each discrete corresponding rib position. The rear edges of the individual ribs would normally form a convex shape corresponding to the concave contoured surface of the reflector, however, there is no definite requirement that this be true, since the rear contour of the rib structure has no electrical function in such a device. Of course, there is no reason why the technique of the invention could not be used to form a convex surface for a particular application. Still further, the depth of the ribs generally normal to the reflector surface may be increased as they approach the lowest horizontal rib (for the case where the reflector orthogonal dimension disposed horizontally is greater than the orthogonal vertical dimension), if there is a purely mechanical reason for so doing.

Ordinarily, the material thickness of the individual ribs would be the same for all rib sets, however, this is not a requirement of the structure of the invention.

The details of construction of the invention will be understood from the description hereinafter made with reference to the drawings. From the detailed description, it will be realized that the structure according to the invention is naturally adapted to a reflector shape approximating an elliptical outline for better performance of an antenna system using a microwave horn illuminator in conjunction with the reflector.

DETAILED DESCRIPTION OF THE PREFERRED EMBODIMENT

Figure 1:
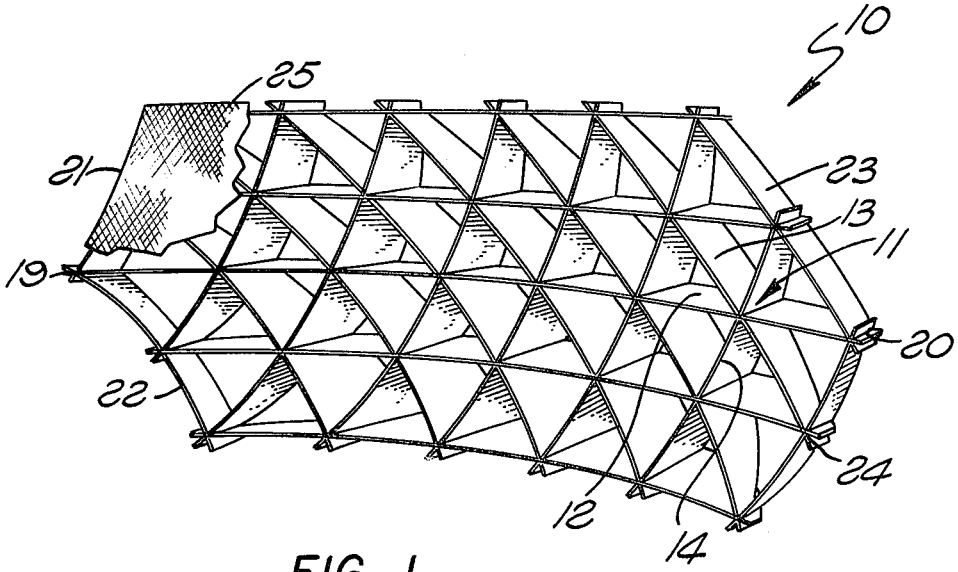
FIG. 1 is a pictorial view of a radar reflector from the concave contoured reflector surface side according to the invention.

Referring now to FIG. 1 a radar reflector structure according to the invention is shown generally at 10. In that illustration, there are five horizontal structural ribs, rib 12 being a typical one. Each of these horizontally disposed ribs of the first set is planar of itself and has an edge 12*a* congruent with the desired contoured reflector surface over the full length of edge 12*a* (i.e. between extremities 19 and 20).

A first diagonal set of structural ribs, of which 13 is typical, comprises a set of parallel planar ribs all oriented at a first acute angle with respect to the horizontally extending ribs, (such as 12) of the first set. This angle may be thought of as in a first sense, i.e. sweeping counterclockwise from a vertical normal passing through function 11. The diagonally oriented third set of planar structural ribs (of which 14 is typical) may be said to be oriented in a second sense with respect to the horizontal ribs, i.e. at an angle sweeping clockwise from the aforementioned normal passing through 11. Thus the corner angles within each of the triangles generated and depicted on FIG. 1 may be equal, in which case the triangles are equilateral. This is not necessarily true however, since the spacing of the horizontal or first set of structural ribs measured vertically might differ from the spacing between adjacent ribs of the first diagonal set or of the second diagonal set. In that latter case, the triangles generated would be isosceles. The bottom horizontal rib 12*b* might be thought of as heavier than the other horizontal ribs such as 12, to provide a strong mounting if a pedestal or other support means were attached directly thereto.

It will be noted that the configuration described and illustrated in FIG. 1 adapts itself to an approximation of an elliptical projected reflector area in that points 19 and 20 are displaced outwardly to the left and right as viewed in FIG. 1, respectively. The edges 21, 22, 23 and 24 are consequently placed so as to enhance this approximation of an elliptical reflector surface.

A conductive mesh 25 is shown fragmentarily for clarity, but it will of course be understood that it is intended that this mesh would be extended over the entire concave contoured conductive reflector surface. The mesh 25, which would normally be of a metallic material would be tack welded or otherwise firmly affixed along the edges of the support ribs which lie adjacent to the contoured reflector surface. The metal mesh 25 may be a relatively simple expanded metal mesh of a commercially available type, or may be of another known type having specially shaped openings for providing desired reflective characteristics over a range of electromagnetic signal polarizations. The criteria for selecting the precise nature of mesh 25 are well understood in the radar arts so that a mesh configuration optimum for any particular type of operation can be provided which acts substantially the same as a continuous conductive sheet.

Figure 2:
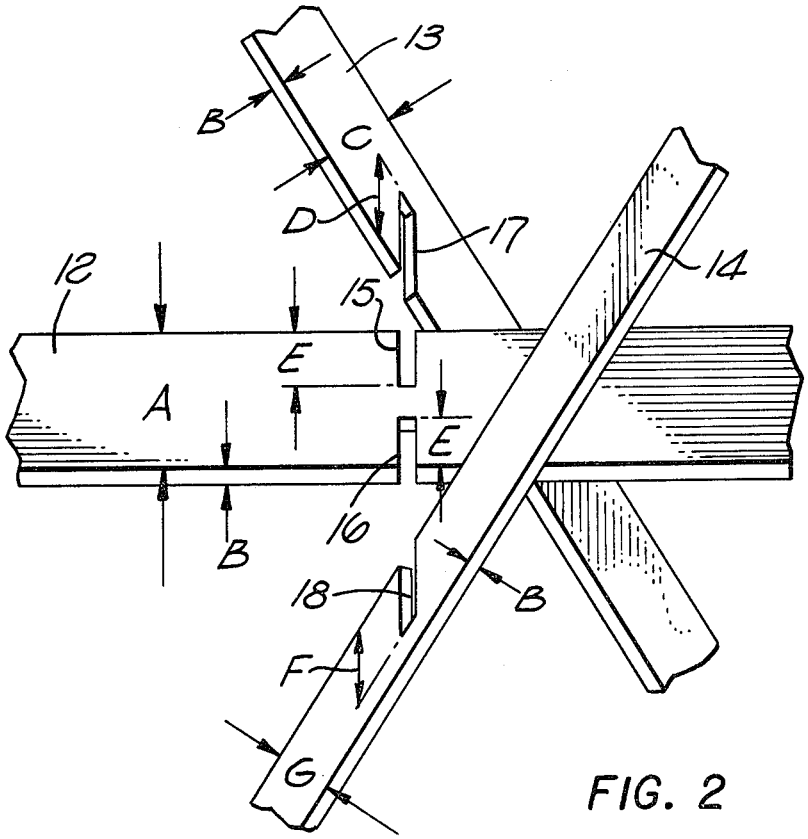
FIG. 2 is an exploded detail showing a typical assembly arrangement at the structural rib cross-overs.

Referring now to FIG. 2, a detail of a typical "egg-crate" type of structural rib assembly point or cross-over, such as point 11 as illustrated on FIG. 1, for example, is shown. If it is assumed that ribs 12, 13 and 14 are of the same depth, i.e. dimension A equals dimension C equals dimension G, then slots 15 and 16 may typically have dimensions E equal to one-third A. Similarly, slots 17 and 18 would typically have dimensions D and F, respectively, equal to two-thirds of dimensions C and G, respectively. It is assumed that the edge thickness of the structural ribs 12, 13 and 14 is uniformly equal to dimension B, however it will be noted that the depth dimensions A, C and G are all much greater than thickness dimensions B.

A weld or braze bead may be applied at each junction (typically 11), that bead running part or all of the rib depth A, C and G for rigidity of assembly.

Modifications and variations of the specific structural details described are obviously possible within the skill of the art. Accordingly, it is not intended that the drawings or this description should be regarded as limiting the scope of the invention, these being typical and illustrative only.

What is claimed is:

1. A structure for a radar reflector in which an accurately contoured reflection surface is provided, comprising:

a first set of elongated, parallel, spaced structural ribs each having a first edge adjacent to and shaped to said contoured reflection surface and each having a first dimension generally normal to said reflection surface, said first dimension being greater than a second dimension which is the thickness of said ribs in a direction substantially tangent to said contoured reflection surface;

second and third sets of elongated, parallel, spaced structural ribs intersecting the ribs of said first set generally diagonally and meshing therewith by means of interlocking slots in said ribs at the points of intersection, said second and third rib sets intersecting said first set ribs in diagonally opposite senses such that a plurality of generally triangular included spaces are generated;

and a relatively thin conductive surface affixed at a plurality of points to said rib edges thereby forming said reflection surface, said ribs of said first, second and third sets being shaped along their first edges according to their respective positions and orientations within said structure to make said first edges congruent with said contoured reflection surface.

2. Apparatus according to claim 1 in which said first dimension of said ribs is at least half of the average dimension of the sides of said triangular space lying along said contoured surface.

3. Apparatus according to claim 1 in which an outside rib of said first set is of greater thickness as compared to the other ribs of said first set, to provide a suitably rigid mounting surface.

4. Apparatus according to claim 1 in which said ribs are all of substantially the same first dimension and said interlocking slots are through substantially two-thirds of the first dimension of said ribs of said second and third sets and said slots are two in numbers and extend one from each edge of the ribs of said first set to a depth of substantially one-third of said first dimension of said ribs of said first set.

5. Apparatus according to claim 2 in which said first dimensions of said first, second and third rib sets are all substantially equal.

6. Apparatus according to claim 5 in which said first dimension of said ribs is at least half of the average dimension of the sides of said triangular space lying along said contoured surface.

7. Apparatus according to claim 6 in which said first dimensions of said ribs are substantially the same as said triangular space sides lying along said contoured surface.

* * * * *